US007775287B2

(12) United States Patent
Duggan et al.

(10) Patent No.: US 7,775,287 B2
(45) Date of Patent: Aug. 17, 2010

(54) METHODS OF ATTACHING A SHANK TO A BODY OF AN EARTH-BORING DRILLING TOOL, AND TOOLS FORMED BY SUCH METHODS

(75) Inventors: James L. Duggan, Friendswood, TX (US); Redd H. Smith, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 224 days.

(21) Appl. No.: 11/637,327

(22) Filed: Dec. 12, 2006

(65) Prior Publication Data

US 2008/0135304 A1 Jun. 12, 2008

(51) Int. Cl.
*E21B 23/00* (2006.01)
*E21B 19/00* (2006.01)
*E21B 10/36* (2006.01)

(52) U.S. Cl. ..... 166/378; 175/320; 175/327; 175/435; 166/242.6

(58) Field of Classification Search ..... 175/435, 175/399, 425, 327, 320; 166/242.6, 378; 411/396, 539
See application file for complete search history.

(56) References Cited

U.S. PATENT DOCUMENTS 1,954,166 A * 4/1934 Campbell ..... 175/336
2,507,439 A * 5/1950 Goolsbee ..... 175/435
2,819,958 A 1/1958 Abkowitz et al.
2,819,959 A 1/1958 Abkowitz et al.
2,906,654 A 9/1959 Abkowitz
3,368,881 A 2/1968 Abkowitz et al.
3,471,921 A 10/1969 Feenstra
3,660,050 A 5/1972 Iler et al.
3,757,879 A 9/1973 Wilder et al.
3,987,859 A 10/1976 Lichte
4,017,480 A 4/1977 Baum (Continued)

FOREIGN PATENT DOCUMENTS

AU 695583 2/1998

(Continued)

OTHER PUBLICATIONS

Alman, D.E., et al., The Abrasive Wear of Sintered Titanium Matrix-Ceramic Particle Reinforced Composites, WEAR, 225-229 (1999), pp. 629-639.

(Continued)

*Primary Examiner*—David J Bagnell
*Assistant Examiner*—Cathleen R Hutchins
(74) *Attorney, Agent, or Firm*—TraskBritt

(57) ABSTRACT

Earth-boring rotary drill bits including a bit body attached to a shank. In some embodiments, the bit body and the shank may have abutting surfaces concentric to an interface axis offset relative to a longitudinal axis of the drill bit. In additional embodiments, the bit body and the shank may have generally frustoconical abutting surfaces. Methods for attaching a shank and a bit body of an earth-boring rotary drill bit include abutting a surface of a shank against a surface of a bit body, and causing the abutting surfaces to be concentric to an axis that is offset or shifted relative to a longitudinal axis of the drill bit.

32 Claims, 7 Drawing Sheets

U.S. PATENT DOCUMENTS

| | | | | |
|---|---|---|---|---|
| 4,047,828 | A | 9/1977 | Makely | |
| 4,094,709 | A | 6/1978 | Rozmus | |
| 4,128,136 | A | 12/1978 | Generoux | |
| 4,198,233 | A | 4/1980 | Frehn | |
| 4,221,270 | A | 9/1980 | Vezirian | |
| 4,229,638 | A | 10/1980 | Lichte | |
| 4,233,720 | A | 11/1980 | Rozmus | |
| 4,252,202 | A | 2/1981 | Purser, Sr. | |
| 4,255,165 | A | 3/1981 | Dennis et al. | |
| 4,306,139 | A | 12/1981 | Shinozaki et al. | |
| 4,341,557 | A | 7/1982 | Lizenby | |
| 4,389,952 | A | 6/1983 | Dreier et al. | |
| 4,499,048 | A | 2/1985 | Hanejko | |
| 4,499,795 | A | 2/1985 | Radtke | |
| 4,499,958 | A | 2/1985 | Radtke et al. | |
| 4,526,748 | A | 7/1985 | Rozmus | |
| 4,547,337 | A | 10/1985 | Rozmus | |
| 4,552,232 | A | 11/1985 | Frear | |
| 4,554,130 | A | 11/1985 | Ecer | |
| 4,562,990 | A | 1/1986 | Rose | |
| 4,596,694 | A | 6/1986 | Rozmus | |
| 4,597,730 | A | 7/1986 | Rozmus | |
| 4,620,600 | A * | 11/1986 | Persson | 175/73 |
| 4,630,693 | A | 12/1986 | Goodfellow | |
| 4,656,002 | A | 4/1987 | Lizenby et al. | |
| 4,667,756 | A | 5/1987 | King et al. | |
| 4,686,080 | A | 8/1987 | Hara et al. | |
| 4,694,919 | A | 9/1987 | Barr | |
| 4,743,515 | A | 5/1988 | Fischer et al. | |
| 4,744,943 | A | 5/1988 | Timm | |
| 4,809,903 | A | 3/1989 | Eylon et al. | |
| 4,817,742 | A | 4/1989 | Whysong | |
| 4,838,366 | A | 6/1989 | Jones | |
| 4,871,377 | A | 10/1989 | Frushour | |
| 4,919,013 | A | 4/1990 | Smith et al. | |
| 4,923,512 | A | 5/1990 | Timm et al. | |
| 4,956,012 | A | 9/1990 | Jacobs et al. | |
| 4,968,348 | A | 11/1990 | Abkowitz et al. | |
| 5,000,273 | A | 3/1991 | Horton et al. | |
| 5,030,598 | A | 7/1991 | Hsieh | |
| 5,032,352 | A | 7/1991 | Meeks et al. | |
| 5,049,450 | A | 9/1991 | Dorfman et al. | |
| 5,090,491 | A | 2/1992 | Tibbitts et al. | |
| 5,101,692 | A | 4/1992 | Simpson | |
| 5,150,636 | A | 9/1992 | Hill | |
| 5,161,898 | A | 11/1992 | Drake | |
| 5,232,522 | A | 8/1993 | Doktycz et al. | |
| 5,281,260 | A | 1/1994 | Kumar et al. | |
| 5,286,685 | A | 2/1994 | Schoennahl et al. | |
| 5,348,806 | A | 9/1994 | Kojo et al. | |
| 5,443,337 | A | 8/1995 | Katayama | |
| 5,482,670 | A | 1/1996 | Hong | |
| 5,484,468 | A | 1/1996 | Ostlund et al. | |
| 5,506,055 | A | 4/1996 | Dorfman et al. | |
| 5,543,235 | A | 8/1996 | Mirchandani et al. | |
| 5,560,440 | A | 10/1996 | Tibbitts | |
| 5,593,474 | A | 1/1997 | Keshavan et al. | |
| 5,611,251 | A | 3/1997 | Katayama | |
| 5,612,264 | A | 3/1997 | Nilsson et al. | |
| 5,624,002 | A | 4/1997 | Huffstutler | |
| 5,641,251 | A | 6/1997 | Leins et al. | |
| 5,641,921 | A | 6/1997 | Dennis et al. | |
| 5,662,183 | A | 9/1997 | Fang | |
| 5,666,864 | A | 9/1997 | Tibbitts | |
| 5,677,042 | A | 10/1997 | Massa et al. | |
| 5,679,445 | A | 10/1997 | Massa et al. | |
| 5,697,046 | A | 12/1997 | Conley | |
| 5,732,783 | A | 3/1998 | Truax et al. | |
| 5,733,649 | A | 3/1998 | Kelley et al. | |
| 5,733,664 | A | 3/1998 | Kelley et al. | |
| 5,753,160 | A | 5/1998 | Takeuchi et al. | |
| 5,765,095 | A | 6/1998 | Flak et al. | |
| 5,776,593 | A | 7/1998 | Massa et al. | |
| 5,778,301 | A | 7/1998 | Hong | |
| 5,789,686 | A | 8/1998 | Massa et al. | |
| 5,792,403 | A | 8/1998 | Massa et al. | |
| 5,806,934 | A | 9/1998 | Massa et al. | |
| 5,830,256 | A | 11/1998 | Northrop et al. | |
| 5,856,626 | A | 1/1999 | Fischer et al. | |
| 5,865,571 | A | 2/1999 | Tankala et al. | |
| 5,880,382 | A | 3/1999 | Fang et al. | |
| 5,897,830 | A | 4/1999 | Abkowitz et al. | |
| 5,957,006 | A | 9/1999 | Smith | |
| 5,963,775 | A | 10/1999 | Fang | |
| 5,980,602 | A | 11/1999 | Carden | |
| 6,029,544 | A | 2/2000 | Katayama | |
| 6,045,750 | A | 4/2000 | Drake et al. | |
| 6,051,171 | A | 4/2000 | Takeuchi et al. | |
| 6,063,333 | A | 5/2000 | Dennis | |
| 6,086,980 | A | 7/2000 | Foster et al. | |
| 6,089,123 | A | 7/2000 | Chow et al. | |
| 6,099,664 | A | 8/2000 | Davies et al. | |
| 6,148,936 | A | 11/2000 | Evans et al. | |
| 6,200,514 | B1 | 3/2001 | Meister | |
| 6,209,420 | B1 | 4/2001 | Butcher et al. | |
| 6,214,134 | B1 | 4/2001 | Eylon et al. | |
| 6,214,287 | B1 | 4/2001 | Waldenstrom | |
| 6,220,117 | B1 | 4/2001 | Butcher | |
| 6,227,188 | B1 | 5/2001 | Tankala et al. | |
| 6,228,139 | B1 | 5/2001 | Oskarrson | |
| 6,241,036 | B1 | 6/2001 | Lovato et al. | |
| 6,254,658 | B1 | 7/2001 | Taniuchi et al. | |
| 6,287,360 | B1 | 9/2001 | Kembaiyan et al. | |
| 6,290,438 | B1 | 9/2001 | Papajewski | |
| 6,293,986 | B1 | 9/2001 | Rodiger et al. | |
| 6,348,110 | B1 | 2/2002 | Evans | |
| 6,375,706 | B2 | 4/2002 | Kembaiyan et al. | |
| 6,453,899 | B1 | 9/2002 | Tselesin | |
| 6,454,025 | B1 | 9/2002 | Runquist et al. | |
| 6,454,028 | B1 | 9/2002 | Evans | |
| 6,454,030 | B1 | 9/2002 | Findley et al. | |
| 6,458,471 | B2 | 10/2002 | Lovato et al. | |
| 6,500,226 | B1 | 12/2002 | Dennis | |
| 6,511,265 | B1 | 1/2003 | Mirchandani et al. | |
| 6,576,182 | B1 | 6/2003 | Ravagni et al. | |
| 6,589,640 | B2 | 7/2003 | Griffin et al. | |
| 6,599,467 | B1 | 7/2003 | Yamaguchi et al. | |
| 6,607,693 | B1 | 8/2003 | Saito et al. | |
| 6,655,481 | B2 | 12/2003 | Findley et al. | |
| 6,685,880 | B2 | 2/2004 | Engstrom et al. | |
| 6,742,608 | B2 | 6/2004 | Murdoch | |
| 6,742,611 | B1 | 6/2004 | Illerhaus et al. | |
| 6,756,009 | B2 | 6/2004 | Sim et al. | |
| 6,849,231 | B2 | 2/2005 | Kojima et al. | |
| 6,918,942 | B2 | 7/2005 | Hatta et al. | |
| 7,044,243 | B2 | 5/2006 | Kembaiyan et al. | |
| 7,048,081 | B2 | 5/2006 | Smith et al. | |
| 7,513,320 | B2 | 4/2009 | Mirchandani et al. | |
| 2003/0010409 | A1 | 1/2003 | Kunze et al. | |
| 2004/0007393 | A1 | 1/2004 | Griffin | |
| 2004/0013558 | A1 | 1/2004 | Kondoh et al. | |
| 2004/0060742 | A1 | 4/2004 | Kembaiyan et al. | |
| 2004/0243241 | A1 | 12/2004 | Istephanous et al. | |
| 2004/0245024 | A1 | 12/2004 | Kembaiyan | |
| 2005/0072496 | A1 | 4/2005 | Hwang et al. | |
| 2005/0117984 | A1 | 6/2005 | Eason et al. | |
| 2005/0126334 | A1 | 6/2005 | Mirchandani | |
| 2005/0211475 | A1 | 9/2005 | Mirchandani et al. | |
| 2005/0247491 | A1 | 11/2005 | Mirchandani et al. | |
| 2005/0268746 | A1 | 12/2005 | Abkowitz et al. | |
| 2006/0016521 | A1 | 1/2006 | Hanusiak et al. | |
| 2006/0043648 | A1 | 3/2006 | Takeuchi et al. | |
| 2006/0057017 | A1 | 3/2006 | Woodfield et al. | |
| 2006/0131081 | A1 | 6/2006 | Mirchandani et al. | |

| | | | | |
|---|---|---|---|---|
| 2007/0042217 | A1 | 2/2007 | Fang et al. | |
| 2007/0102198 | A1* | 5/2007 | Oxford et al. | 175/374 |

FOREIGN PATENT DOCUMENTS

| | | | |
|---|---|---|---|
| CA | 2212197 | | 10/2000 |
| EP | 0 453 428 | A1 | 10/1991 |
| EP | 0 995 876 | A2 | 4/2000 |
| EP | 1 244 531 | B1 | 10/2002 |
| GB | 945227 | | 12/1963 |
| GB | 1050116 | | 12/1966 |
| GB | 2203774 | A | 10/1988 |
| GB | 2238812 | A | 6/1991 |
| GB | 2330787 | A | 5/1999 |
| GB | 2 385 350 | A | 8/2003 |
| GB | 2 393 449 | A | 3/2004 |
| GB | 2425080 | A | 10/2006 |
| GB | 2426020 | A | 11/2006 |
| JP | 10 219385 | A | 8/1998 |
| WO | 9907977 | A1 | 2/1999 |
| WO | WO 03/049889 | A2 | 6/2003 |
| WO | WO 2004/053197 | A2 | 6/2004 |

OTHER PUBLICATIONS

Boron Carbide Nozzles and Inserts, Seven Stars International webpage http://www.concentric.net/ ~ctkang/nozzle.shtml, printed Sep. 7, 2006.

Choe, Heeman, et al., Effect of Tungsten Additions on the Mechanical Properties of Ti-6A1-4V, Material Science and Engineering, A 396 2005, pp. 99-106, Elsevier Inc.

Diamond Innovations, Composite Diamond Coatings, Superhard Protection of Wear Parts New Coating and Service Parts from Diamond Innovations brochure, 2004.

Gale, W.F., et al., Smithells Metals Reference Book, Eighth Edition, 2003, p. 2,117, Elsevier Butterworth Heinemann.

Heat Treating of Titanium and Titanium Alloys, Key to Metals website article, www.key-to-metals.com.

Miserez, A., et al. Particle Reinforced Metals of High Ceramic Content, Material Science and Engineering A 387-389 (2004), pp. 822-831, Elsevier.

Reed, James S., Principles of Ceramics Processing, Second Edition, 1995, pp. 215-227, John Wiley & Sons, Inc.

Warrier, S.G., et al., Infiltration of Titanium Alloy-Matrix Composites, Journal of Materials Science Letters, 12 (1993), pp. 865-868, Chapman & Hall.

U.S. Appl. No. 11/271,153, filed Nov. 10, 2005, entitled "Earth-Boring Rotary Drill Bits and Methods of Forming Earth-Boring Rotary Drill Bits" to Oxford et al.

U.S. Appl. No. 11/272,439, filed Nov. 10, 2005 entitled "Earth-Boring Rotary Drill Bits and Methods of Manufacturing Earth-Boring Rotary Drill Bits Having Particle-Matrix Composite Bit Bodies" Smith et al.

U.S. Appl. No. 11/540,912, filed Sep. 29, 2006, entitled "Earth-Boring Rotary Drill Bits Including Bit Bodies Having Boron Carbide Particles in Aluminum or Aluminum-Based Alloy Matrix Materials, and Methods for Forming Such Bits" to Choe et al.

U.S. Appl. No. 11/593,437, filed Nov. 6, 2006, entitled "Earth-Boring Rotary Drill Bits Including Bit Bodies Comprising Reinforced Titanium or Titanium-Based Alloy Matrix Materials, and Methods for Forming Such Bits" to Choe et al.

PCT International Search Report for counterpart PCT International Application No. PCT/US2007/023275, mailed Apr. 11, 2008.

PCT International Search Report and Written Opinion of the International Search Authority for PCT Counterpart Application No. PCT/US2006/043670, mailed Apr. 2, 2007.

U.S. Appl. No. 60/566,063, filed Apr. 28, 2004, entitled "Body Materials for Earth Boring Bits" to Mirchandani et al.

PCT International Search Report for International Application No. PCT/US2007/025102, mailed May 28, 2008.

US 4,966,627, 10/1990, Keshavan et al. (withdrawn)

* cited by examiner

METHODS OF ATTACHING A SHANK TO A BODY OF AN EARTH-BORING DRILLING TOOL, AND TOOLS FORMED BY SUCH METHODS

FIELD OF THE INVENTION

The present invention generally relates to earth-boring drill bits and other tools that may be used to drill subterranean formations, and to methods of manufacturing such drill bits and tools. More particularly, the present invention relates to methods for attaching a shank to a body of a tool such as an earth-boring rotary drill bit, and to drill bits and other tools that include a shank attached to a body.

BACKGROUND OF THE INVENTION

Rotary drill bits are commonly used for drilling bore holes or wells in earth formations. One type of rotary drill bit is the fixed-cutter bit (often referred to as a "drag" bit), which typically includes a plurality of cutting elements secured to a face region of a bit body. The bit body of a rotary drill bit may be formed from steel. Alternatively, the bit body may be formed from a particle-matrix composite material. A conventional earth-boring rotary drill bit 10 is shown in FIG. 1 that includes a bit body 12 comprising a particle-matrix composite material 15. The bit body 12 is secured to a steel shank 20 having a threaded connection portion 28 (e.g., an American Petroleum Institute (API) threaded connection portion) for attaching the drill bit 10 to a drill string (not shown). The bit body 12 includes a crown 14 and a steel blank 16. The steel blank 16 is partially embedded in the crown 14. The crown 14 includes a particle-matrix composite material 15, such as, for example, particles of tungsten carbide embedded in a copper alloy matrix material. The bit body 12 is secured to the steel shank 20 by way of a threaded connection 22 and a weld 24 extending around the drill bit 10 on an exterior surface thereof along an interface between the bit body 12 and the steel shank 20.

The bit body 12 further includes wings or blades 30 that are separated by junk slots 32. Internal fluid passageways (not shown) extend between the face 18 of the bit body 12 and a longitudinal bore 40, which extends through the steel shank 20 and partially through the bit body 12. Nozzle inserts (not shown) also may be provided at the face 18 of the bit body 12 within the internal fluid passageways.

A plurality of cutting elements 34 are attached to the face 18 of the bit body 12. Generally, the cutting elements 34 of a fixed-cutter type drill bit have either a disk shape or a substantially cylindrical shape. A cutting surface 35 comprising a hard, super-abrasive material, such as mutually bound particles of polycrystalline diamond, may be provided on a substantially circular end surface of each cutting element 34. Such cutting elements 34 are often referred to as "polycrystalline diamond compact" (PDC) cutting elements 34. The PDC cutting elements 34 may be provided along the blades 30 within pockets 36 formed in the face 18 of the bit body 12, and may be supported from behind by buttresses 38, which may be integrally formed with the crown 14 of the bit body 12. Typically, the cutting elements 34 are fabricated separately from the bit body 12 and secured within the pockets 36 formed in the outer surface of the bit body 12. A bonding material such as an adhesive or, more typically, a braze alloy may be used to secure the cutting elements 34 to the bit body 12.

During drilling operations, the drill bit 10 is secured to the end of a drill string, which includes tubular pipe and equipment segments coupled end to end between the drill bit 10 and other drilling equipment at the surface. The drill bit 10 is positioned at the bottom of a well bore hole such that the cutting elements 34 are adjacent the earth formation to be drilled. Equipment such as a rotary table or top drive may be used for rotating the drill string and the drill bit 10 within the bore hole. Alternatively, the shank 20 of the drill bit 10 may be coupled directly to the drive shaft of a down-hole motor, which then may be used to rotate the drill bit 10. As the drill bit 10 is rotated, drilling fluid is pumped to the face 18 of the bit body 12 through the longitudinal bore 40 and the internal fluid passageways (not shown). Rotation of the drill bit 10 causes the cutting elements 34 to scrape across and shear away the surface of the underlying formation. The formation cuttings mix with and are suspended within the drilling fluid and pass through the junk slots 32 and the annular space between the well bore hole and the drill string to the surface of the earth formation.

Conventionally, bit bodies that include a particle-matrix composite material 15, such as the previously described bit body 12, have been fabricated in graphite molds using a so-called "infiltration" process. The cavities of the graphite molds are conventionally machined with a multi-axis machine tool. Fine features are then added to the cavity of the graphite mold by hand-held tools. Additional clay work also may be required to obtain the desired configuration of some features of the bit body. Where necessary, preform elements or displacements (which may comprise ceramic components, graphite components, or resin-coated sand compact components) may be positioned within the mold and used to define the internal passages, cutting element pockets 36, junk slots 32, and other external topographic features of the bit body 12. The cavity of the graphite mold is filled with hard particulate carbide material (such as tungsten carbide, titanium carbide, tantalum carbide, etc.). The preformed steel blank 16 may then be positioned in the mold at the appropriate location and orientation. The steel blank 16 typically is at least partially submerged in the particulate carbide material within the mold.

The mold then may be vibrated or the particles otherwise packed to decrease the amount of space between adjacent particles of the particulate carbide material. A matrix material (often referred to as a "binder" material), such as a copper-based alloy, may be melted, and caused or allowed to infiltrate the particulate carbide material within the mold cavity. The mold and bit body 12 are allowed to cool to solidify the matrix material. The steel blank 16 is bonded to the particle-matrix composite material 15 forming the crown 14 upon cooling of the bit body 12 and solidification of the matrix material. Once the bit body 12 has cooled, the bit body 12 is removed from the mold and any displacements are removed from the bit body 12. Destruction of the graphite mold typically is required to remove the bit body 12.

The PDC cutting elements 34 may be bonded to the face 18 of the bit body 12 after the bit body 12 has been cast by, for example, brazing, mechanical, or adhesive affixation. Alternatively, the cutting elements 34 may be bonded to the face 18 of the bit body 12 during furnacing of the bit body 12 if thermally stable synthetic or natural diamonds are employed in the cutting elements 34.

After the bit body 12 has been formed, the bit body 12 may be secured to the steel shank 20. As the particle-matrix composite materials 15 typically used to form the crown 14 are relatively hard and not easily machined, the steel blank 16 is used to secure the bit body 12 to the shank 20. Complementary threads may be machined on exposed surfaces of the steel blank 16 and the shank 20 to provide the threaded connection 22 therebetween. The steel shank 20 may be threaded onto the bit body 12, and the weld 24 then may be provided along the interface between the bit body 12 and the steel shank 20.

BRIEF SUMMARY OF THE INVENTION

In one embodiment, the present invention includes an earth-boring rotary drill bit having a bit body attached to a shank. The bit body and the shank may have abutting surfaces that are concentric to an axis that is offset or shifted relative to a longitudinal axis of the drill bit.

In another embodiment, the present invention includes a method of attaching a shank and a bit body of an earth-boring rotary drill bit. At least one surface of the shank is abutted against at least one surface of the bit body, and the abutting surfaces are caused to be concentric to an axis that is offset or shifted relative to a longitudinal axis of the drill bit.

In yet another embodiment, the present invention includes an earth-boring rotary drill bit comprising a bit body having a connection portion thereof attached to a metal shank. The connection portion of the bit body may be predominantly comprised of a particle-matrix composite material. The connection portion of the bit body and the shank may include abutting surfaces, at least a portion of which may have a generally frustoconical shape.

Further embodiments of the present invention include, without limitation, core bits, bi-center bits, eccentric bits, so-called "reamer wings" as well as drilling and other downhole tools employing a body having a shank secured thereto in accordance with the present invention. Therefore, as used herein, the term "drill bit" encompasses all such structures.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

DETAILED DESCRIPTION OF THE INVENTION

Figure 1:
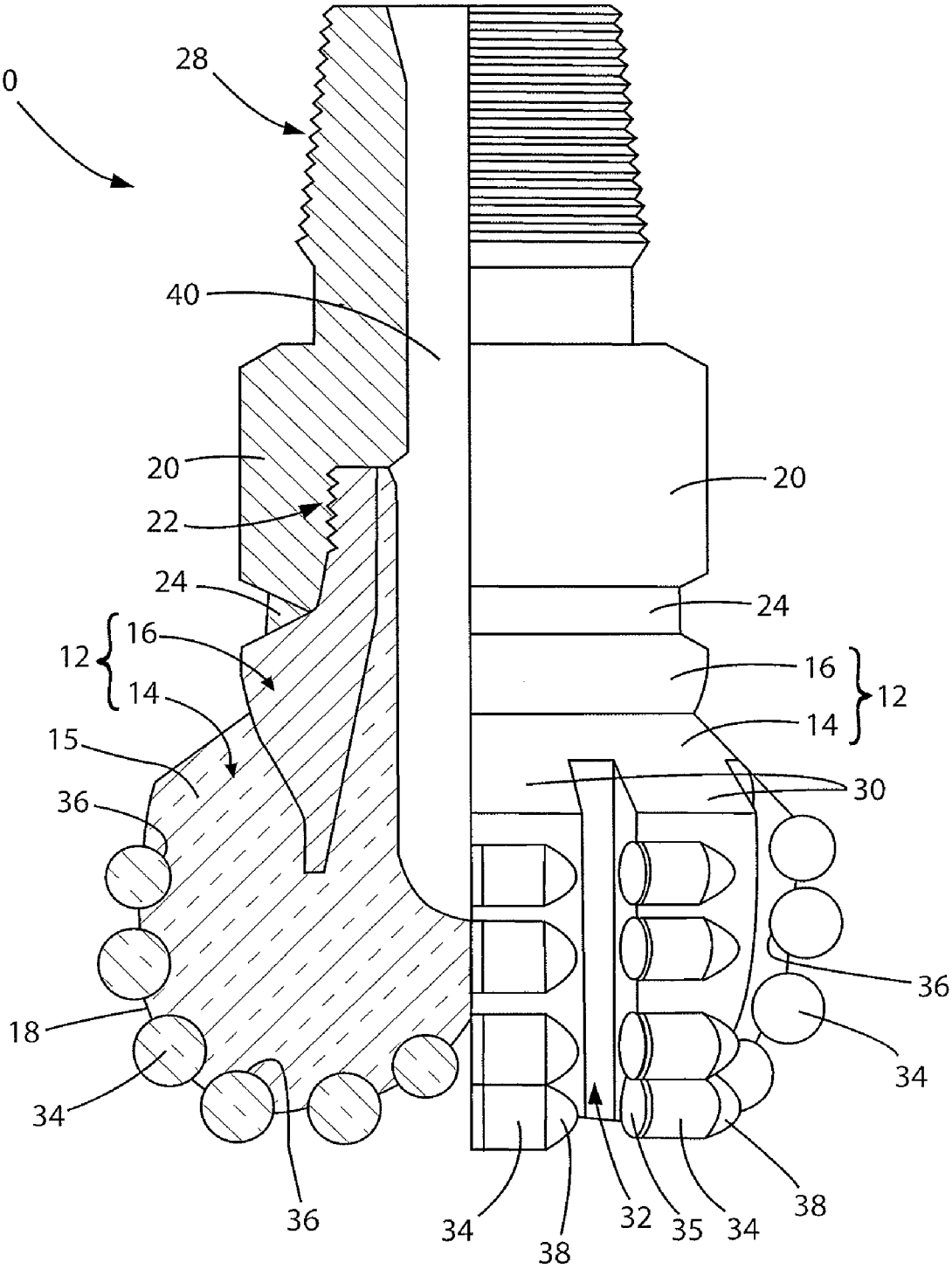
FIG. 1 (PRIOR ART)
FIG. 1 is a partial cross-sectional side view of a conventional earth-boring rotary drill bit that has a bit body that includes a particle-matrix composite material.

The illustrations presented herein are not meant to be actual views of any particular material, apparatus, system, or method, but are merely idealized representations which are employed to describe the present invention. Additionally, elements common between figures may retain the same numerical designation.

As previously discussed, it can be difficult to secure a metal shank, such as the previously described shank 20 (FIG. 1) to a bit body formed from a relatively hard and abrasive material, such as a particle-matrix composite material. As conventional particle-matrix composite bit bodies generally include a matrix material having a relatively low melting-point (e.g., a copper-based alloy) and are formed by the previously described infiltration process, a metal blank, such as the previously described metal blank 16 (FIG. 1), can be provided in the bit body as the bit body is formed and used to facilitate attachment of the bit body to a shank for attachment to a drill string. For example, complementary threads may be machined on the metal blank and the shank, and the shank may be threaded onto the metal blank, as previously discussed.

The depth of well bores being drilled continues to increase as the number of shallow depth hydrocarbon-bearing earth formations continues to decrease. These increasing well bore depths are pressing conventional drill bits to their limits in terms of performance and durability. Several drill bits are often required to drill a single well bore, and changing a drill bit on a drill string can be expensive.

New particle-matrix composite materials are currently being investigated in an effort to improve the performance and durability of earth-boring rotary drill bits. Examples of such new particle-matrix composite materials are disclosed in, for example, pending U.S. patent application Ser. No. 11/272,439, filed Nov. 10, 2005, pending U.S. patent application Ser. No. 11/540,912, filed Sep. 29, 2006, and pending U.S. patent application Ser. No. 11/593,437, filed Nov. 6, 2006, the disclosure of each of which application is incorporated herein in its entirety by this reference.

Such new particle-matrix composite materials may include matrix materials that have a melting point relatively higher than the melting point of conventional matrix materials used in infiltration processes. By way of example and not limitation, nickel-based alloys, cobalt-based alloys, cobalt and nickel-based alloys, aluminum-based alloys, and titanium-based alloys are being considered for use as matrix materials in new particle-matrix composite materials. Such new matrix materials may have a melting point that is proximate to or higher than the melting points of metal alloys (e.g., steel alloys) conventionally used to form a metal blank, and/or they may be chemically incompatible with such metal alloys conventionally used to form a metal blank, such as the previously described metal blank 16.

Furthermore, bit bodies that comprise such new particle-matrix composite materials may be formed from methods other than the previously described infiltration processes. By way of example and not limitation, bit bodies that include such particle-matrix composite materials may be formed using powder compaction and sintering techniques. Examples of such techniques are disclosed in the abovementioned pending U.S. patent application Ser. No. 11/272,439, filed Nov. 10, 2005, and in pending U.S. patent application Ser. No. 11/271,153, also filed Nov. 10, 2005, the disclosure of which is also incorporated herein in its entirety by this reference. Such techniques may require sintering at temperatures proximate to or higher than the melting points of metal alloys (e.g., steel alloys) conventionally used to form a metal blank, such as the previously described metal blank 16.

In view of the above, it may be difficult or impossible to provide a metal blank in bit bodies formed from or comprising such new particle-matrix composite materials. As a result, it may be relatively difficult to attach a drill bit comprising a bit body formed from such new particle-matrix materials to a shank or other component of a drill string. Methods for attaching a bit body of an earth-boring rotary drill bit and a shank and that may be used with bit bodies comprising such new particle-matrix composite materials are described below with reference to FIGS. 2-9.

Figure 2:
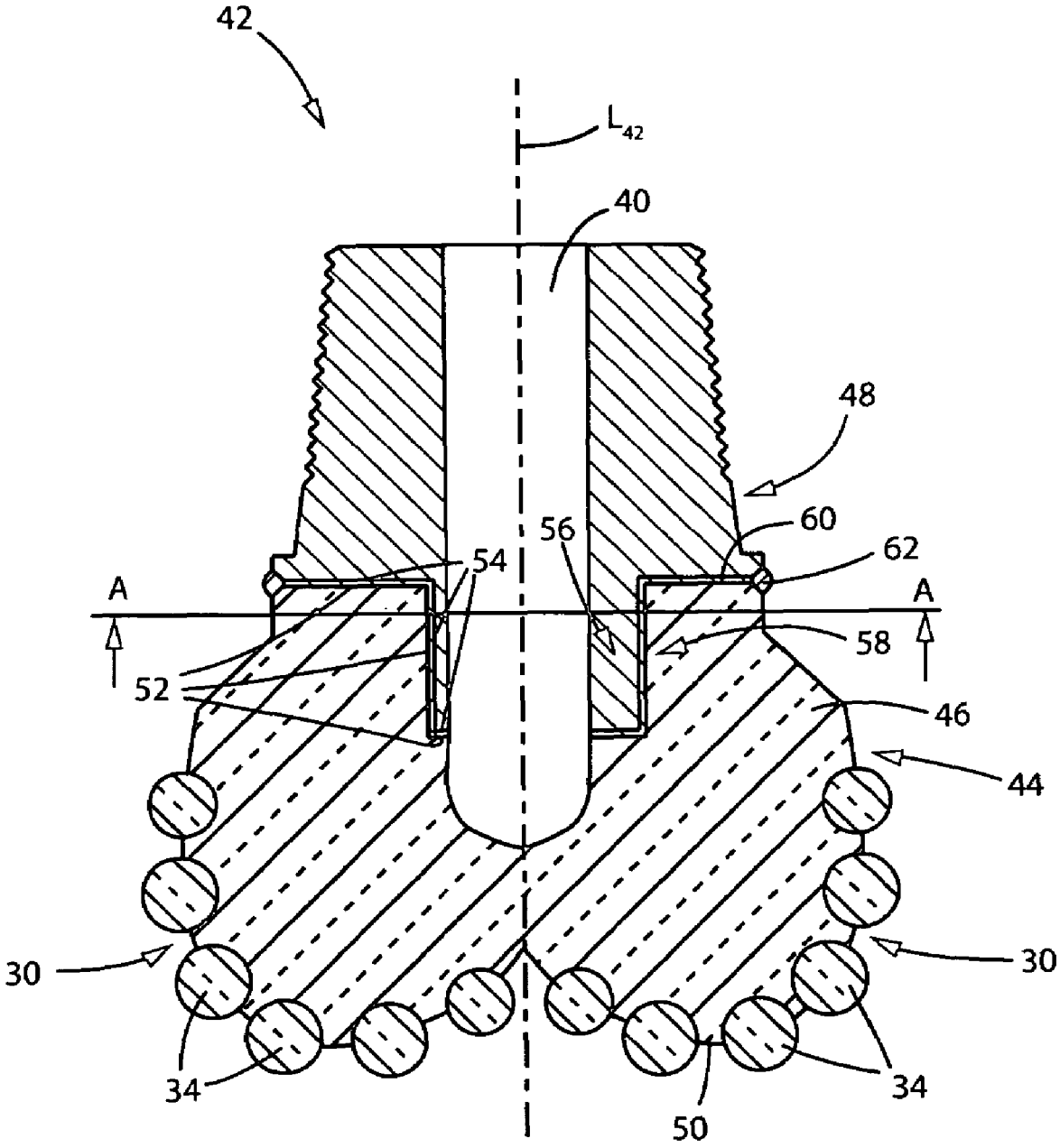
FIG. 2 is a cross-sectional side view of one example of an earth-boring rotary drill bit that embodies teachings of the present invention and includes a shank directly attached to a portion of a bit body of the drill bit that includes a particle-matrix composite material.

An earth-boring rotary drill bit 42 that embodies teachings of the present invention is shown in FIG. 2. The drill bit 42 includes a bit body 44 comprising a particle-matrix composite material 46. By way of example and not limitation, the particle-matrix composite material 46 may comprise a plurality of hard particles dispersed throughout a matrix material, the hard particles comprising a material selected from diamond, boron carbide, boron nitride, aluminum nitride, and carbides or borides of the group consisting of W, Ti, Mo, Nb, V, Hf, Zr, Si, Ta, and Cr, the matrix material selected from the group consisting of iron-based alloys, nickel-based alloys, cobalt-based alloys, titanium-based alloys; aluminum-based alloys, iron and nickel-based alloys, iron and cobalt-based alloys, and nickel and cobalt-based alloys. As used herein, the term "[metal]-based alloy" (where [metal] is any metal) means commercially pure [metal] in addition to metal alloys wherein the weight percentage of [metal] in the alloy is greater than the weight percentage of any other component of the alloy.

The bit body 44 is attached to a shank 48, as described in further detail below. In some embodiments, the bit body 44 may include a plurality of blades 30 that are separated by junk slots 32 (similar to those shown in FIG. 1). A plurality of cutting elements 34 (which may include, for example, PDC cutting elements) may be mounted on the face 50 of the bit body 44 along each of the blades 30.

The drill bit 42 shown in FIG. 2 may not include a metal blank, such as the metal blank 16 of the drill bit 10 (FIG. 1). In contrast, the shank 48 may be secured directly to the particle-matrix composite material 46 of the bit body 44, as shown in FIG. 2. One or more surfaces 52 of the bit body 44 may be configured to abut against one or more complementary surfaces 54 of the shank 48. In some embodiments, a braze alloy 60 or other adhesive material may be provided between the abutting surfaces 52, 54 of the bit body 44 and the shank 48 to at least partially secure the bit body 44 and the shank 48, as shown in FIG. 2. In additional embodiments, there may be no braze alloy 60 or other adhesive material between the abutting surfaces 52, 54.

For purposes of illustration, the thickness of the braze alloy 60 shown in FIGS. 2-9 has been exaggerated. In actuality, the surfaces 52, 54 on opposite sides of the braze alloy 60 may abut one another over substantially the entire area between the surfaces 52, 54, as described herein, and any braze alloy 60 provided between the surfaces 52, 54 may be substantially disposed in the relatively small gaps or spaces between the opposing surfaces that arise due to surface roughness or imperfections in or on the opposing surfaces. It is also contemplated that surface features, such as lands, may be provided on one or both of the opposing and abutting surfaces for defining a gap or standoff having a predefined thickness of less than about 500 microns (about 0.02 inch) between the opposing and abutting surfaces. As used herein, the term "abutting surfaces" includes opposing surfaces that abut one another over a wide area between the surfaces, as well as opposing surfaces that abut one another at least primarily at surface features that provide a selected standoff or gap between the surfaces for receiving a braze alloy 60 or other adhesive material therebetween.

As also shown in FIG. 2, in some embodiments, the shank 48 may comprise a male connection portion, such as a pin member 56, and the bit body 44 may comprise a female connection portion, such as a receptacle or recess 58 having a complementary size and shape to the pin member 56. One or more of the abutting surfaces 54 of the shank 48 may comprise or define external surfaces of the pin member 56 of the shank 48, and one or more of the abutting surfaces 52 of the bit body 44 may comprise or define the complementary recess 58 of the bit body 44. In some embodiments, at least a portion of at least one surface 52 of the bit body 44 and a corresponding portion of at least one surface 54 of the shank 48 may have a generally cylindrical or oval shape.

To secure the bit body 44 and the shank 48, the pin member 56 of the shank 48 may be inserted into the recess 58 of the bit body 44 until the surfaces 52 of the bit body 44 abut against the surfaces 54 of the shank 48. As described above, a braze alloy 60 or other adhesive material optionally may be provided between the abutting surfaces 52, 54 of the bit body 44 and the shank 48 to at least partially secure the bit body 44 and the shank 48. In additional embodiments, a weld 62 may be provided along an interface between the bit body 44 and the shank 48 to at least partially secure the shank 48 to the bit body 44. In yet other embodiments, the bit body 44 and the shank 48 may be at least partially secured together using mechanical fastening means, such as, for example, pin members (not shown) that extend at least partially through both the bit body 44 and the shank 48, such as those described in pending U.S. patent application Ser. No. 11/272,439, filed Nov. 10, 2005.

Figure 3:
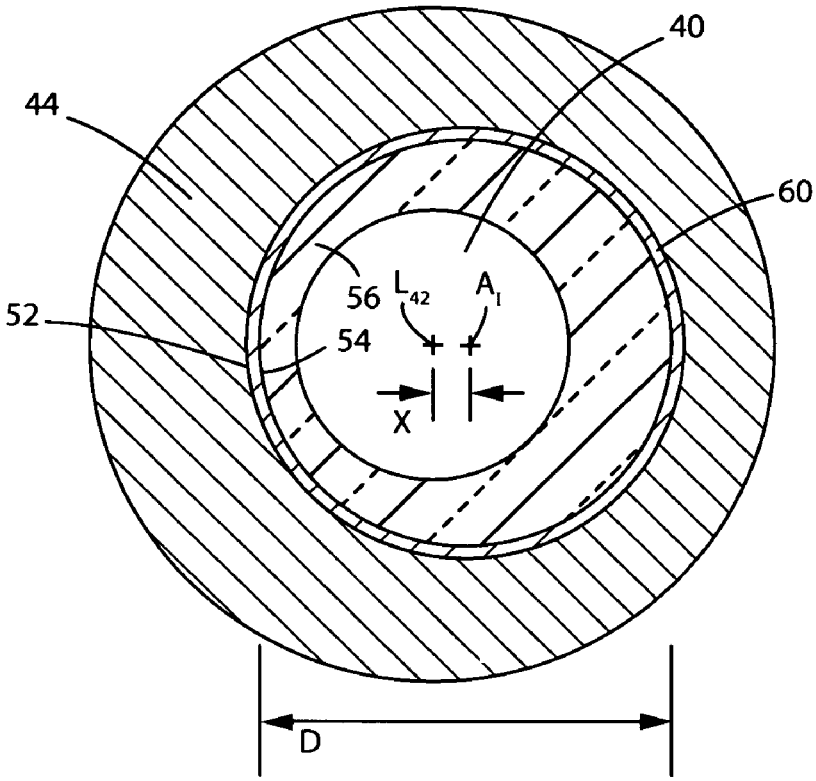
FIG. 3 is a cross-sectional view of one embodiment of the drill bit shown in FIG. 2 taken along section line A-A shown therein.

FIG. 3 is a cross-sectional view of the drill bit 42 shown in FIG. 2 taken along section line A-A shown therein. As shown in FIG. 3, in some embodiments, the abutting surfaces 52, 54 of the bit body 44 and the shank 48 may be concentric to (i.e., both centered about) an interface axis $A_I$ that is not aligned with the longitudinal axis $L_{42}$ of the drill bit 42. For example, interface axis $A_I$ may be offset or shifted (e.g., laterally offset or shifted) from or relative to the longitudinal axis $L_{42}$ of the rotary drill bit 42. By way of example and not limitation, the interface axis $A_I$ may be laterally offset or shifted from or relative to the longitudinal axis $L_{42}$ of the rotary drill bit 42 by a distance X that is between about one percent (1%) and about fifty percent (50%) of an exterior diameter D of the pin member 56 of the shank 48. Furthermore, the abutting surfaces 52, 54 of the bit body 44 and the shank 48 that are concentric to the interface axis $A_I$ may have a substantially circular shape, as shown in FIG. 3. In additional embodiments, the abutting surfaces 52, 54 of the bit body 44 and the shank 48 that are concentric to the interface axis $A_I$ may have an ovular or elliptical shape, or any other simple or complex shape that is centered about the interface axis $A_I$.

By forming or otherwise causing the abutting surfaces 52, 54 to be concentric to an interface axis $A_I$ that is laterally offset or shifted from or relative to the longitudinal axis $L_{42}$ of the rotary drill bit 42, as shown in FIGS. 2 and 3, mechanical interference between the bit body 44 and the shank 48 may prevent or hinder relative rotational movement between the shank 48 and the bit body 48. In other words, as a torque is applied to the shank 48 by a drill string or a drive shaft of a downhole motor (not shown) during a drilling operation, mechanical interference between the bit body 44 and the shank 48 may prevent failure of the joint (e.g., failure of the braze alloy 60 and/or the weld 62) between the bit body 44 and the shank 48 and rotational slippage at the interface between the abutting surfaces 52, 54 of the bit body 44 and the shank 48.

In some applications or situations, however, it may not be necessary or desired to form or otherwise cause the abutting surfaces 52, 54 to be concentric to an interface axis $A_I$ that is laterally offset or shifted from or relative to the longitudinal axis $L_{42}$ of the rotary drill bit 42. In additional embodiments, the abutting surfaces 52, 54 may be concentric to the longitudinal axis $L_{42}$ of the rotary drill bit 42, as shown in FIG. 4.

Figure 4:
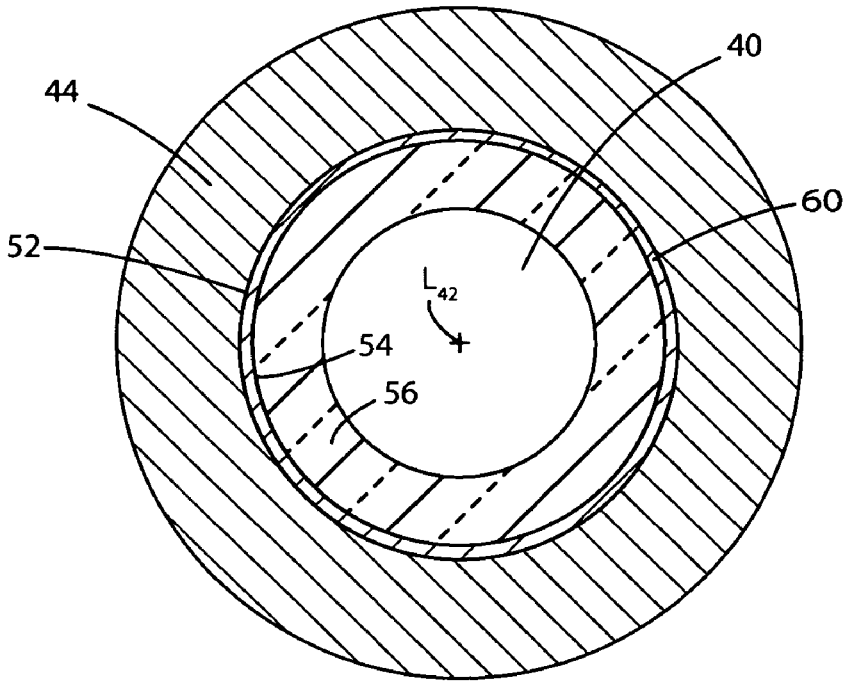
FIG. 4 is a cross-sectional view of another embodiment of the drill bit shown in FIG. 2 taken along section line A-A shown therein.
Figure 5:
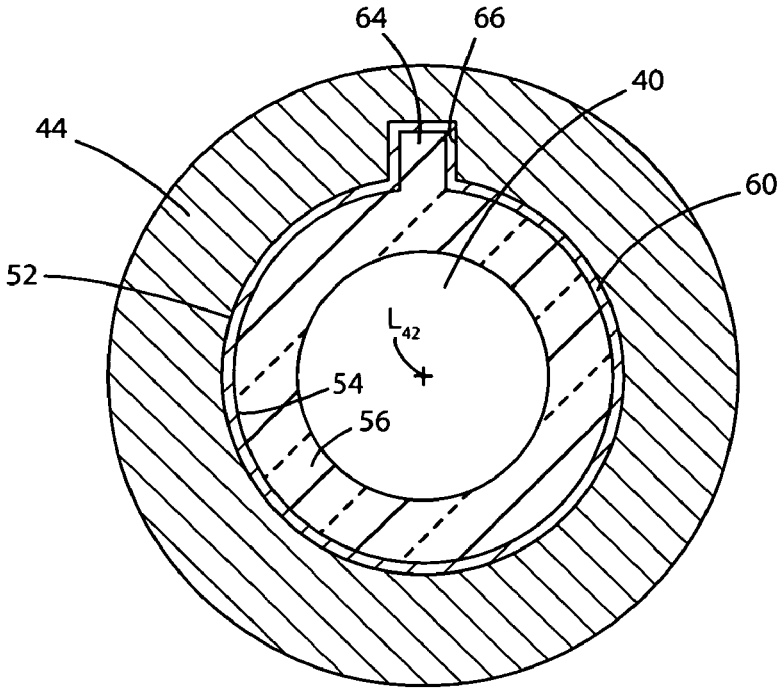
FIG. 5 is a cross-sectional view of yet another embodiment of the drill bit shown in FIG. 2 taken along section line A-A shown therein.

FIG. 5 is a cross-sectional view like those shown in FIGS. 3 and 4 illustrating yet another embodiment of the present invention. As shown in FIG. 5, in some embodiments, a shape of the surface 54 of the pin member 56 of the shank 48 may be configured to define or comprise at least one protrusion 64, and a shape of the surface 52 of the bit body 44 may be configured to define or comprise at least one recess 66 that is configured to receive the protrusion 64 therein.

Figure 6:
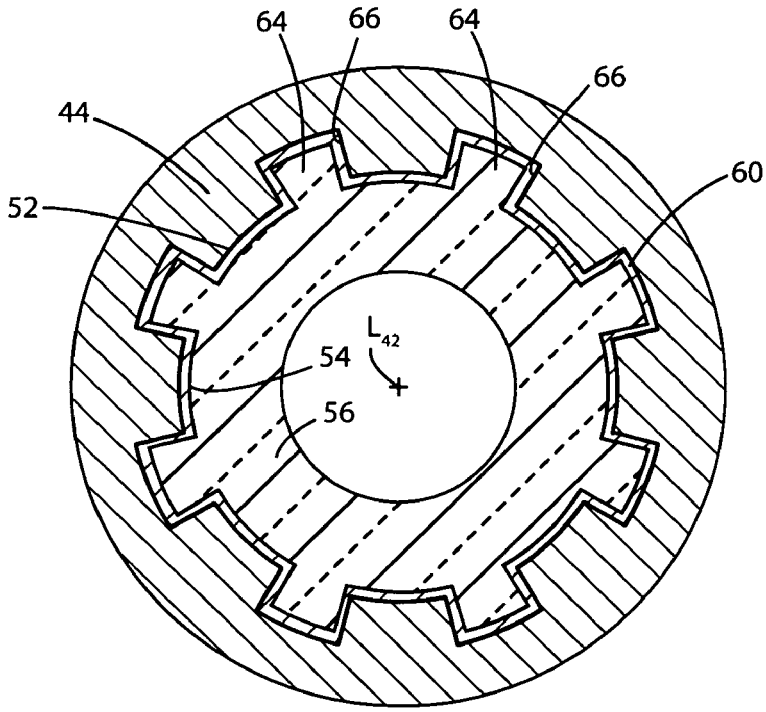
FIG. 6 is a cross-sectional view of an additional embodiment of the drill bit shown in FIG. 2 taken along section line A-A shown therein.

FIG. 6 is another cross-sectional view like those shown in FIGS. 3-5 illustrating an additional embodiment of the present invention. As shown in FIG. 6, in some embodiments, a shape of the surface 54 of the pin member 56 of the shank 48 may be configured to define or comprise a plurality of protrusions 64, and a shape of the surface 52 of the bit body 44 may be configured to define or comprise a plurality of recesses 66 that are each configured to receive a protrusion 64 therein.

The protrusions 64 shown in cross-section in FIGS. 5 and 6 may project from the pin member 56 of the shank 48 in a generally radial outward direction, and may extend along the surface of the pin member 56 of the shank 48 in a generally longitudinal direction, relative to the longitudinal axis $L_{42}$ of the rotary drill bit 42 (FIG. 2). Furthermore, although the protrusions 64 and the complementary recess 66 are shown in FIGS. 5 and 6 as including relatively sharp corners and edges, in additional embodiments, the relatively sharp corners and edges may be replaced with radiused or smoothly curved corners and edges to minimize any concentration of stress that might occur at such sharp corners and edges during a drilling operation. The protrusions 64 and the recesses 66 shown in FIGS. 5 and 6 may include keys (e.g., so-called "Woodruff Keys") and keyways (e.g., so-called "Woodruff Keyslots"), respectively.

In additional embodiments, the protrusions 64 shown in FIGS. 5 and 6 may be defined by the surface 52 of the bit body 44, and the recesses 66 shown in FIGS. 5 and 6 may be defined by the surface 54 of the pin member 56 of the shank 48. Additionally, although the protrusions 64 and recesses 66 are shown in FIGS. 5 and 6 as being provided on the abutting surfaces 52, 54 that are concentric to the longitudinal axis $L_{42}$, as shown in FIG. 4, in additional embodiments, protrusions 64 and recesses 66 may be provided on abutting surfaces 52, 54 that are approximately concentric to an interface axis Al that is laterally offset or shifted from or relative to the longitudinal axis $L_{42}$ of the rotary drill bit 42, such as those shown in FIGS. 2 and 3.

The protrusions 64 and complementary recesses 66 shown in FIGS. 5 and 6 may provide an additional or alternative method of providing mechanical interference between the bit body 44 and the shank 48 to prevent or hinder relative rotational movement between the shank 48 and the bit body 44 when a torque is applied to the shank 48 during a drilling operation.

Figure 7:
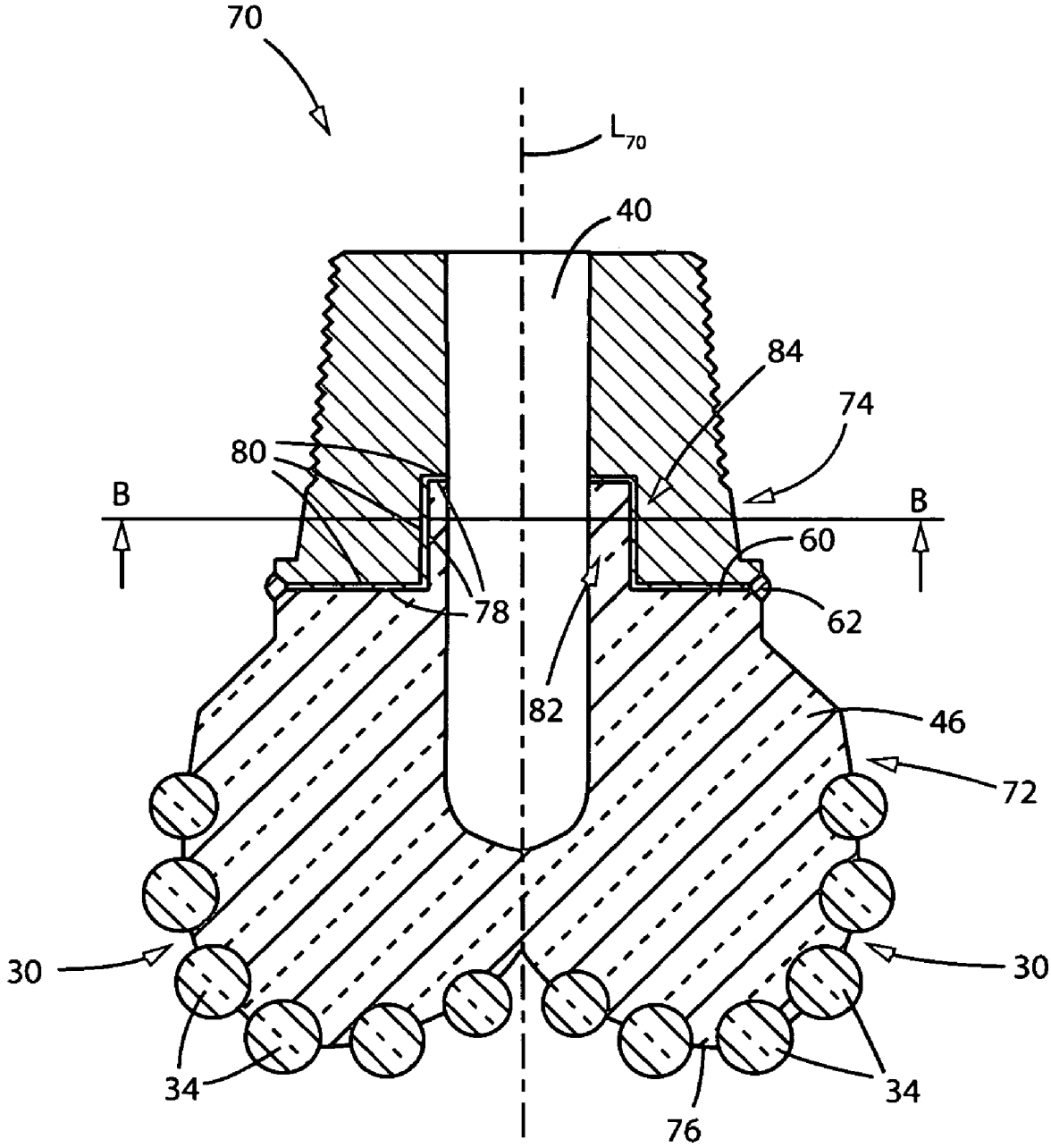
FIG. 7 is a cross-sectional side view of another example of an earth-boring rotary drill bit that embodies teachings of the present invention.

FIG. 7 is a cross-sectional side view of another earth-boring rotary drill bit 70 that embodies teachings of the present invention. The earth-boring rotary drill bit 70 is similar to the drill bit 42 previously described in relation to FIGS. 2-6, and includes a bit body 72 attached directly to a shank 74. One or more surfaces 78 of the bit body 72 may be configured to abut against one or more complementary surfaces 80 of the shank 74. Cutting elements 34, such as PDC cutting elements, may be secured to a face 76 of the bit body 72. In the earth-boring rotary drill bit 70, however, the bit body 72 comprises a male connection portion, such as a pin member 82, and the shank 74 comprises a female connection portion, such as a receptacle or recess 84 having a complementary size and shape to the pin member 82. One or more of the abutting surfaces 78 of the bit body 72 may comprise external surfaces of the pin member 82 of the bit body 72, and one or more of the abutting surfaces 80 of the shank 74 may define the complementary recess 84 in the shank 74.

The bit body 72 and the shank 74 of the drill bit 70 may be formed or otherwise provided in any number of different configurations that embody teachings of the present invention. For example, the bit body 72 and the shank 74 of the drill bit 70 may be formed or otherwise provided such that a cross-sectional view of the drill bit 70, taken along section line B-B shown in FIG. 7, appears substantially similar to any one of FIGS. 3-6. In other words, the abutting surfaces 78, 80 of the bit body 72 and the shank 74, may be configured to be concentric to an interface axis $A_I$ that is laterally offset or shifted from or relative to the longitudinal axis $L_{70}$ of the rotary drill bit 70, in a manner similar to that shown in FIG. 3. In additional embodiments, the abutting surfaces 78, 80 of the bit body 72 and the shank 74, may be configured to be concentric to the longitudinal axis $L_{70}$ of the rotary drill bit 70, in a manner similar to that shown in FIG. 4. Furthermore, protrusions and complementary recesses, such as the protrusions 64 and complementary recesses 66 previously described in relation to FIGS. 5 and 6, may be defined by the abutting surfaces 78, 80 of the bit body 72 and the shank 74.

Figure 8:
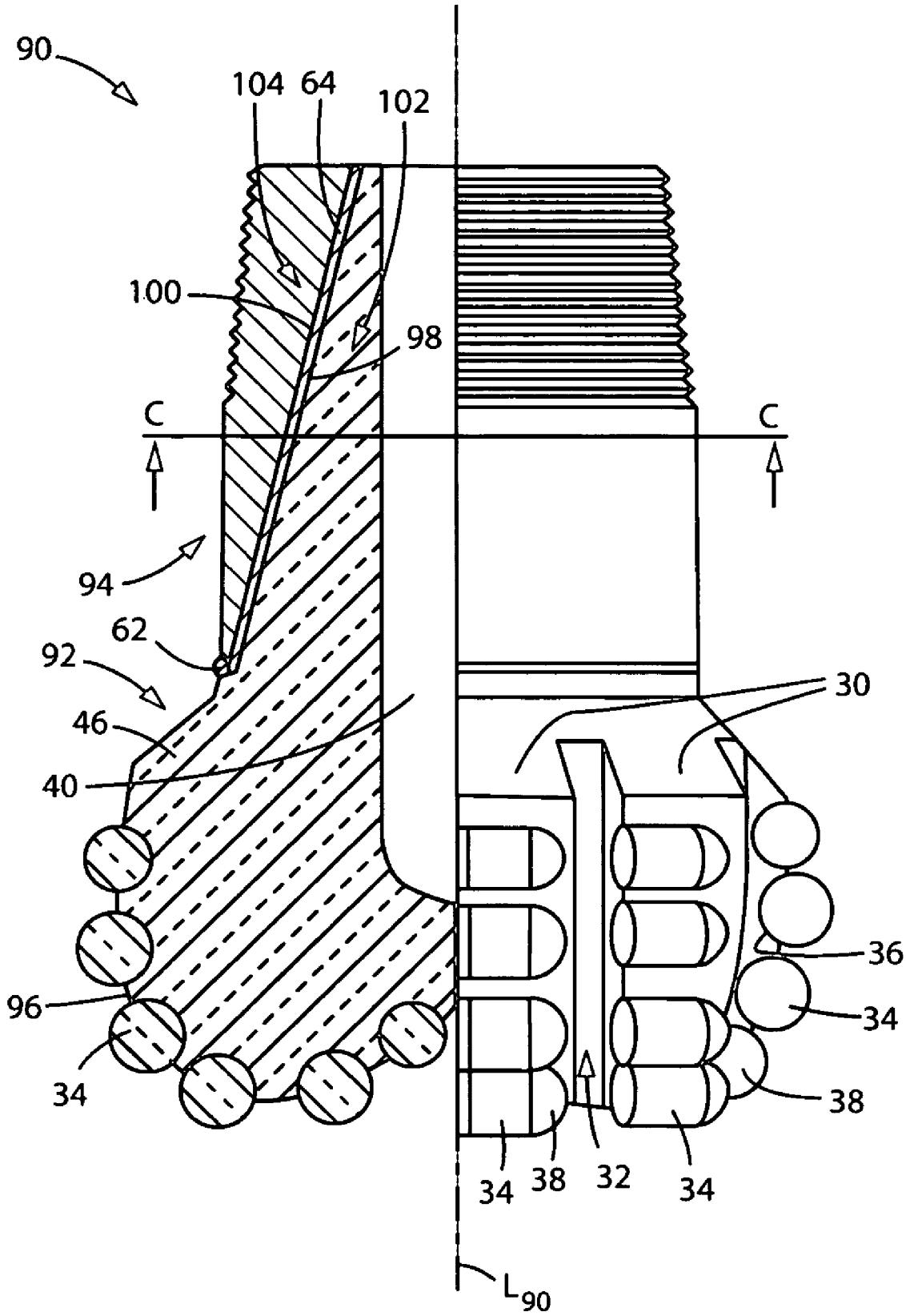
FIG. 8 is a partial cross-sectional side view of an additional example of an earth-boring rotary drill bit that embodies teachings of the present invention.

FIG. 8 is a partial cross-sectional side view of another earth-boring rotary drill bit 90 that embodies teachings of the present invention. The earth-boring rotary drill bit 90 also includes a bit body 92 attached directly to a shank 94. One or more surfaces 98 of the bit body 92 may be configured to abut against one or more complementary surfaces 100 of the shank 94. In some embodiments, the bit body 92 may include a plurality of blades 30 that are separated by junk slots 32, as shown in FIG. 8. A plurality of PDC cutting elements 34 may be mounted on the face 96 of the bit body 92 along each of the blades 30.

Like the previously described drill bit 42 and the previously described drill bit 70, the drill bit 90 shown in FIG. 8 does not include a metal blank, such as the metal blank 16 of the drill bit 10 (FIG. 1), but is secured directly to the particle-matrix composite material 46 of the bit body 92. As also shown in FIG. 8, in some embodiments, the bit body 92 may comprise a male connection portion, such as a pin member 102, and the shank 94 may comprise a female connection portion, such as a receptacle or recess 104 having a complementary size and shape to the pin member 102 and configured to receive the pin member 102 therein. One or more of the surfaces 98 of the bit body 92 may comprise external surfaces of the pin member 102 of the bit body 92, and one or more of the surfaces 100 of the shank 94 may define the complementary recess 104 in the shank 94. Furthermore, in some embodiments, at least a portion of at least one surface 98 of the bit body 92 and a corresponding complementary portion of at least one surface 100 of the shank 94 may have a generally frustoconical shape, as shown in FIG. 8. In some embodiments, the frustoconical surfaces 98, 100 may be substantially smooth and free of threads.

The bit body 92 and the shank 94 of the drill bit 90 also may be formed or otherwise provided such that a cross-sectional view of the drill bit 90, taken along section line C-C shown in FIG. 8, appears substantially similar to any one of FIGS. 3-6. In other words, the abutting surfaces 98, 100 of the bit body 92 and the shank 94, may be configured to be concentric to an interface axis Al that is laterally offset or shifted from or relative to the longitudinal axis $L_{90}$ of the rotary drill bit 90, in a manner similar to that shown in FIG. 3. In additional embodiments, the abutting surfaces 98, 100 of the bit body 92 and the shank 94, may be configured to be concentric to the longitudinal axis $L_{90}$ of the rotary drill bit 90, in a manner similar to that shown in FIG. 4. Furthermore, protrusions and complementary recesses, such as the protrusions 64 and complementary recesses 66 previously described in relation to FIGS. 5 and 6, may be defined by the abutting surfaces 98, 100 of the bit body 92 and the shank 94.

Figure 9:
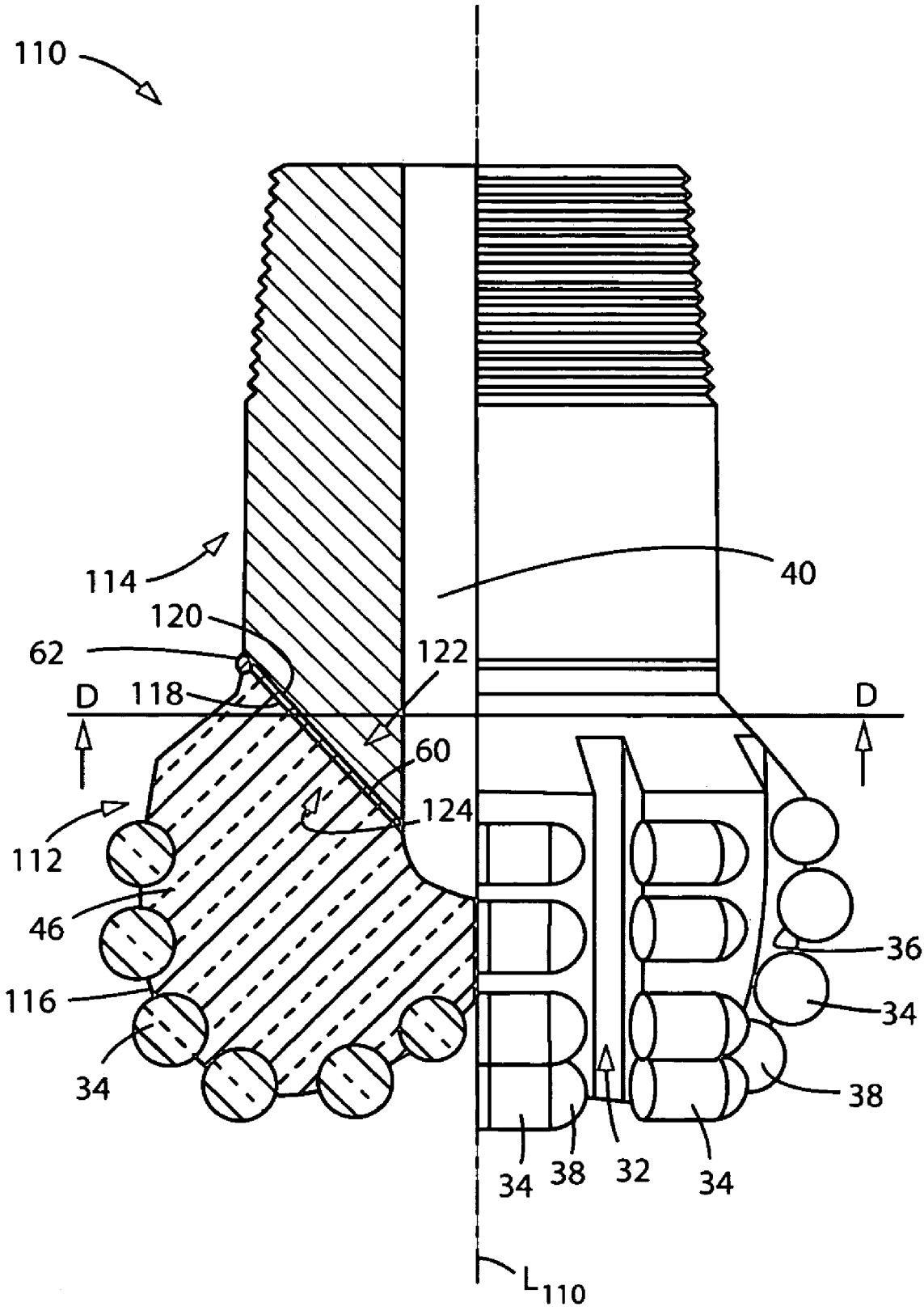
FIG. 9 is a partial cross-sectional side view of yet another example of an earth-boring rotary drill bit that embodies teachings of the present invention and includes a shank directly attached to a portion of a bit body of the drill bit that includes a particle-matrix composite material.

FIG. 9 is a partial cross-sectional side view of yet another earth-boring rotary drill bit 110 that embodies teachings of the present invention. The earth-boring rotary drill bit 110 is substantially similar to the drill bit 90 previously described in relation to FIG. 8, and includes a bit body 112 attached directly to a shank 114. One or more surfaces 118 of the bit body 112 may be configured to abut against one or more complementary surfaces 120 of the shank 114. Cutting elements 34 may be secured to a face 116 of the bit body 112. In the earth-boring rotary drill bit 110, however, the shank 114 comprises a male connection portion, such as a pin member 122, and the bit body 112 comprises a female connection portion, such as a receptacle or recess 124 having a size and shape complementary to a size and shape of the pin member 122 for receiving the pin member 122 therein. One or more of the abutting surfaces 120 of the shank 114 may comprise external surfaces of the pin member 122 of the shank 114, and one or more of the abutting surfaces 118 of the bit body 112 may define the complementary recess 124 in the bit body 112.

The bit body 112 and the shank 114 of the drill bit 110 may be formed or otherwise provided such that a cross-sectional view of the drill bit 110, taken along section line D-D shown in FIG. 9, appears substantially similar to any one of FIGS. 3-6. In other words, the abutting surfaces 118, 120 of the bit body 112 and the shank 114, may be configured to be concentric to an interface axis $A_I$ that is laterally offset or shifted from or relative to the longitudinal axis $L_{110}$ of the rotary drill bit 110, in a manner similar to that shown in FIG. 3. In additional embodiments, the abutting surfaces 118, 120 of the bit body 112 and the shank 114, may be configured to be concentric to the longitudinal axis $L_{110}$ of the rotary drill bit 110, in a manner similar to that shown in FIG. 4. Furthermore, protrusions and complementary recesses, such as the protrusions 64 and complementary recesses 66 previously described in relation to FIGS. 5 and 6, may be defined by the abutting surfaces 118, 120 of the bit body 112 and the shank 114.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors.

What is claimed is:

1. An earth-boring rotary drill bit comprising:

a metal shank comprising a threaded end configured for attachment to a drill string; and a separately formed bit body comprising a particle-matrix composite material attached directly to the metal shank, the metal shank being rotationally fixed relative to the bit body;

wherein the bit body and the metal shank comprise abutting surfaces concentric to an interface axis offset from a longitudinal and rotational axis of the drill bit, the longitudinal and rotational axis of the drill bit extending along a longitudinal center of the threaded end of the metal shank and a longitudinal center of the bit body.

2. The rotary drill bit of claim 1, wherein a shape of one of the abutting surfaces defines at least one protrusion, and wherein a shape of another of the abutting surfaces defines at least one recess, the at least one protrusion disposed at least partially within the at least one recess.

3. The rotary drill bit of claim 2, wherein the at least one protrusion projects into the at least one recess in a generally lateral direction relative to the longitudinal and rotational axis of the drill bit.

4. The rotary drill bit of claim 1, wherein the metal shank comprises a male connection portion and the bit body comprises a female connection portion configured to receive the male connection portion of the metal shank at least partially therein, an exterior surface of the male connection portion and an interior surface of the female connection portion defining the abutting surfaces.

5. The rotary drill bit of claim 4, wherein at least a portion of each of the exterior surface of the male connection portion and the interior surface of the female connection portion has a generally cylindrical shape.

6. The rotary drill bit of claim 1, wherein the bit body comprises a male connection portion and the metal shank comprises a female connection portion configured to receive the male connection portion of the bit body at least partially therein, an exterior surface of the male connection portion and an interior surface of the female connection portion defining the abutting surfaces.

7. The rotary drill bit of claim 6, wherein at least a portion of each of the exterior surface of the male connection portion and the interior surface of the female connection portion has a generally frustoconical shape.

8. The rotary drill bit of claim 1, further comprising at least one of a weld and a brazing material at an interface between the bit body and the metal shank.

9. The rotary drill bit of claim 1, further comprising at least one cutting element secured to a face of the bit body.

10. The rotary drill bit of claim 1, wherein the interface axis is parallel to and laterally offset from the longitudinal and rotational axis of the drill bit.

11. The rotary drill bit of claim 1, wherein the metal shank comprises a unitary structure extending from a surface of the abutting surfaces to the threaded end of the metal shank.

12. A method of attaching a shank and a bit body of an earth-boring rotary drill bit, the method comprising:

abutting at least one surface of a metal shank against at least one surface of a separately formed bit body of an earth-boring rotary drill bit;

causing the abutting surfaces to be concentric to an interface axis offset from and parallel to a longitudinal and rotational axis of the drill bit; and fixing the metal shank to the bit body to prevent rotation of the metal shank relative to the bit body.

13. The method of claim 12, further comprising:

forming one of the abutting surfaces to define at least one protrusion;

forming another of the abutting surfaces to define at least one recess; and inserting the at least one protrusion at least partially into the at least one recess.

14. The method of claim 13, wherein forming one of the abutting surfaces to define at least one protrusion comprises forming one of the abutting surfaces to define at least one protrusion projecting in a generally lateral direction relative to the longitudinal and rotational axis of the drill bit.

15. The method of claim 12, further comprising:

providing a male connection portion on the shank;

providing a female connection portion on the bit body;

inserting the male connection portion of the shank into the female connection portion of the bit body;

causing an exterior surface of the male connection portion to abut against an interior surface of the female connection portion; and causing the abutting exterior surface of the male connection portion and the interior surface of the female connection portion to be concentric to the interface axis.

16. The method of claim 15, further comprising forming at least a portion of each of the exterior surface of the male connection portion and the interior surface of the female connection portion to have a generally cylindrical shape.

17. The method of claim 12, further comprising:

providing a male connection portion on the bit body;

providing a female connection portion on the shank;

inserting the male connection portion of the bit body into the female connection portion of the shank;

causing an exterior surface of the male connection portion to abut against an interior surface of the female connection portion; and causing the abutting exterior surface of the male connection portion and the interior surface of the female connection portion to be concentric to the interface axis.

18. The method of claim 17, further comprising forming at least a portion of each of the exterior surface of the male connection portion and the interior surface of the female connection portion to have a generally frustoconical shape.

19. The method of claim 12, further providing at least one of a weld and a brazing material at an interface between the bit body and the shank.

20. The method of claim 12, further comprising securing at least one cutting element to a face of the rotary drill bit.

21. The method of claim 12, further comprising forming the drill bit and positioning the drill bit relative to the shank to cause exterior surfaces of the drill bit to be at least generally concentric to a longitudinal and rotational axis of the drill bit.

22. An earth-boring rotary drill bit comprising a bit body having a connection portion thereof directly attached to a separately formed metal shank configured for attachment to a drill string, the connection portion of the bit body predominantly comprising a particle-matrix composite material, the connection portion of the bit body and the shank having abutting surfaces, at least a portion of the abutting surfaces having a generally frustoconical shape, wherein the abutting surfaces are concentric to an interface axis offset from and parallel to a longitudinal and rotational axis of the drill bit.

23. The rotary drill bit of claim 22, wherein the abutting surfaces are free of threads.

24. The rotary drill bit of claim 23, wherein the abutting surfaces are substantially smooth.

25. The rotary drill bit of claim 22, wherein the particle matrix composite material comprises a plurality of hard particles dispersed throughout a matrix material, the hard particles comprising a material selected from diamond, boron carbide, boron nitride, aluminum nitride, and carbides or borides of the group consisting of W, Ti, Mo, Nb, V, Hf, Zr, Si, Ta, and Cr, the matrix material selected from the group consisting of iron-based alloys, nickel-based alloys, cobalt-based alloys, titanium-based alloys, aluminum-based alloys, iron and nickel-based alloys, iron and cobalt-based alloys, and nickel and cobalt-based alloys.

26. The rotary drill bit of claim 22, further comprising at least one of a weld and a brazing material at an interface between the bit body and the shank.

27. The rotary drill bit of claim 22, further comprising:

at least one protrusion extending from one of the generally frustoconical exterior surface of the bit body and the at least a portion of the generally frustoconical interior surface of the shank; and at least one complementary recess configured to receive the at least one protrusion therein, the at least one complementary recess formed in one of the at least a portion of the generally frustoconical exterior surface of the bit body and the at least a portion of the generally frustoconical interior surface of the shank.

28. The rotary drill bit of claim 22, further comprising at least one cutting element secured to a face of the drill bit.

29. The rotary drill bit of claim 22, wherein a shape of one of the abutting surfaces defines at least one protrusion, and wherein a shape of another of the abutting surfaces defines at least one recess, the at least one protrusion disposed at least partially within the at least one recess.

30. The rotary drill bit of claim 29, wherein the at least one protrusion projects into the at least one recess in a generally lateral direction relative to a longitudinal and rotational axis of the drill bit.

31. The rotary drill bit of claim 22, wherein the shank comprises a male connection portion and the bit body comprises a female connection portion configured to receive the male connection portion of the shank at least partially therein, an exterior surface of the male connection portion and an interior surface of the female connection portion defining the abutting surfaces.

32. The rotary drill bit of claim 22, wherein the bit body comprises a male connection portion and the shank comprises a female connection portion configured to receive the male connection portion of the bit body at least partially therein, an exterior surface of the male connection portion and an interior surface of the female connection portion defining the abutting surfaces.

* * * * *